US009927209B2

(12) United States Patent
Sharrah et al.

(10) Patent No.: US 9,927,209 B2
(45) Date of Patent: Mar. 27, 2018

(54) PORTABLE LIGHT WITH MULTIPLE LIGHT SOURCES

(71) Applicant: Streamlight, Inc., Eagleville, PA (US)

(72) Inventors: Raymond L. Sharrah, Collegeville, PA (US); John C. DiNenna, Norristown, PA (US); Thomas D. Boris, Collegeville, PA (US); Jon C. Zeisler, Collegeville, PA (US)

(73) Assignee: STREAMLIGHT, INC., Eagleville, PA (US)

( * ) Notice: Subject to any disclaimer, the term of this patent is extended or adjusted under 35 U.S.C. 154(b) by 0 days.

(21) Appl. No.: 14/669,917

(22) Filed: Mar. 26, 2015

(65) Prior Publication Data

US 2015/0276347 A1 Oct. 1, 2015

Related U.S. Application Data

(60) Provisional application No. 61/971,841, filed on Mar. 28, 2014.

(51) Int. Cl.

| | |
|---|---|
| ***F41G 1/35*** | (2006.01) |
| ***F21V 23/04*** | (2006.01) |
| ***F21V 33/00*** | (2006.01) |
| ***F21V 7/00*** | (2006.01) |
| ***F21L 4/00*** | (2006.01) |
| ***F21V 21/14*** | (2006.01) |
| ***F21V 21/34*** | (2006.01) |
| *F21W 111/10* | (2006.01) |

(Continued)

(52) U.S. Cl.

CPC ..... *F41G 1/35* (2013.01); *F21L 4/00* (2013.01); *F21V 7/0075* (2013.01); *F21V 21/145* (2013.01); *F21V 21/34* (2013.01); *F21V 23/0414* (2013.01); *F21V 23/0442* (2013.01); *F21V 33/008* (2013.01); *F21W 2111/10* (2013.01); *F21Y 2115/10* (2016.08); *F41G 11/003* (2013.01)

(58) Field of Classification Search

CPC ..... F41G 1/34; F41G 1/35; F41G 1/36; F41G 11/003; F21V 33/008; F21V 7/0075; F21V 21/145; F21V 21/34; F21V 23/0414; F21V 23/0442; F21L 4/02; F21W 2111/10; F21Y 2101/02

USPC ..... 42/114, 117

See application file for complete search history.

(56) References Cited

U.S. PATENT DOCUMENTS 5,375,362 A * 12/1994 McGarry ..... F41G 1/35 42/117
5,481,819 A * 1/1996 Teetzel ..... F41A 9/62 42/117

(Continued)

FOREIGN PATENT DOCUMENTS

WO 2006/055439 5/2006

OTHER PUBLICATIONS

U.S. Appl. No. 14/726,849, filed Jun. 1, 2015.

*Primary Examiner* — Bret Hayes

(74) *Attorney, Agent, or Firm* — Dann, Dorfman, Herrell and Skillman; Stephen Eland

(57) ABSTRACT

A light for mounting on an implement is provided. In particular, a light configured to be releasably attached to a firearm is provided. The light includes first and second light elements. A selector switch is operable to select which of the two light elements is energized when a primary switch is actuated.

33 Claims, 6 Drawing Sheets

(51) Int. Cl.
*F41G 11/00* (2006.01)
*F21Y 115/10* (2016.01)

(56) References Cited

U.S. PATENT DOCUMENTS 5,522,167 A * 6/1996 Teetzel ..... F41A 9/62 250/208.4
5,584,137 A * 12/1996 Teetzel ..... F41A 9/62 362/114
5,642,932 A * 7/1997 Matthews ..... F21V 23/0421 362/202
5,685,105 A * 11/1997 Teetzel ..... F41A 9/62 362/114
5,822,905 A * 10/1998 Teetzel ..... F41C 23/16 362/114
6,276,088 B1 * 8/2001 Matthews ..... F21L 4/005 362/110
6,675,521 B1 * 1/2004 Kim ..... F41G 1/35 42/114
7,188,978 B2 * 3/2007 Sharrah ..... F21S 9/02 248/216.4
7,614,760 B2 * 11/2009 Sharrah ..... F21S 9/02 362/111
D612,970 S 3/2010 Sharrah et al.
8,226,267 B2 * 7/2012 Sharrah ..... F21S 9/02 361/792
8,287,157 B2 * 10/2012 Sharrah ..... F21V 21/0885 362/310
D674,525 S 1/2013 Sharrah et al.
8,371,729 B2 * 2/2013 Sharrah ..... F21S 9/02 362/439
8,529,083 B1 * 9/2013 Reed ..... F41C 27/00 362/110
8,584,392 B1 * 11/2013 Young ..... F41G 1/35 42/114
2007/0277422 A1 * 12/2007 Ding ..... F41G 1/35 42/146
2008/0180946 A1 * 7/2008 Kim ..... F21L 4/005 362/205
2009/0111454 A1 * 4/2009 Jancic ..... F41G 1/35 455/420
2009/0116231 A1 * 5/2009 Miller ..... F21V 17/02 362/208
2009/0226802 A1 * 9/2009 Frick ..... F21V 23/0414 429/149
2010/0095574 A1 * 4/2010 Abst ..... F41G 1/35 42/69.01
2010/0154279 A1 * 6/2010 Polyzos ..... F41C 23/10 42/117
2010/0162610 A1 * 7/2010 Moore ..... F41G 1/35 42/115
2011/0235313 A1 9/2011 Canella
2012/0020063 A1 * 1/2012 Mironichev ..... F21L 4/025 362/191
2013/0148367 A1 6/2013 Sharrah et al.
2015/0124436 A1 * 5/2015 Galli ..... F41G 11/003 362/110
2015/0276352 A1 * 10/2015 Chang ..... F41G 11/003 42/114

* cited by examiner

FIG. 8
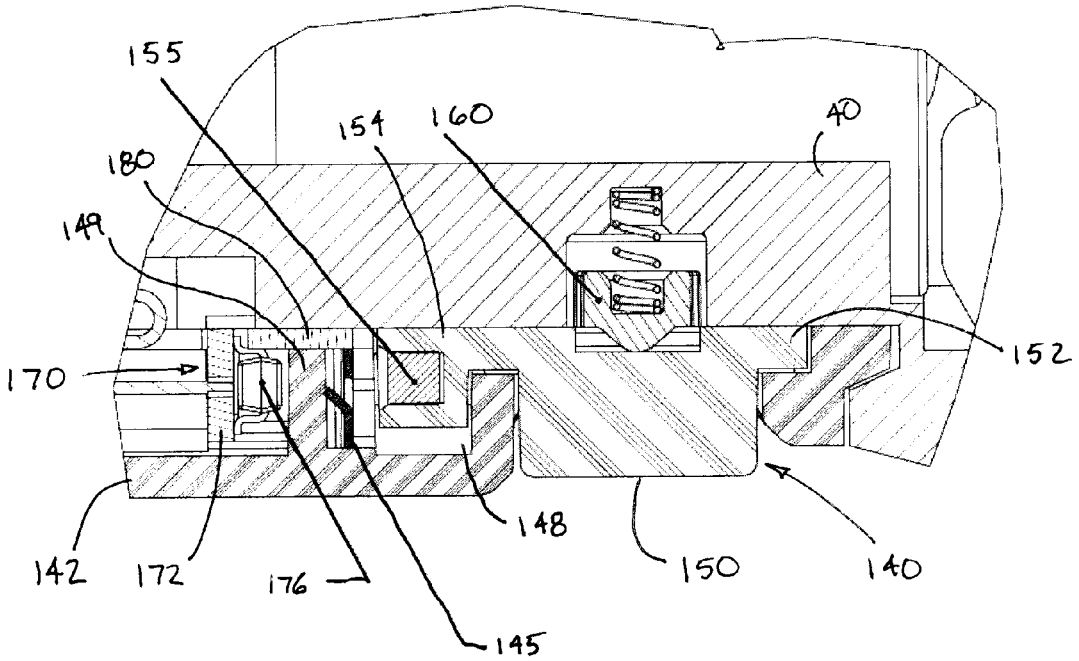
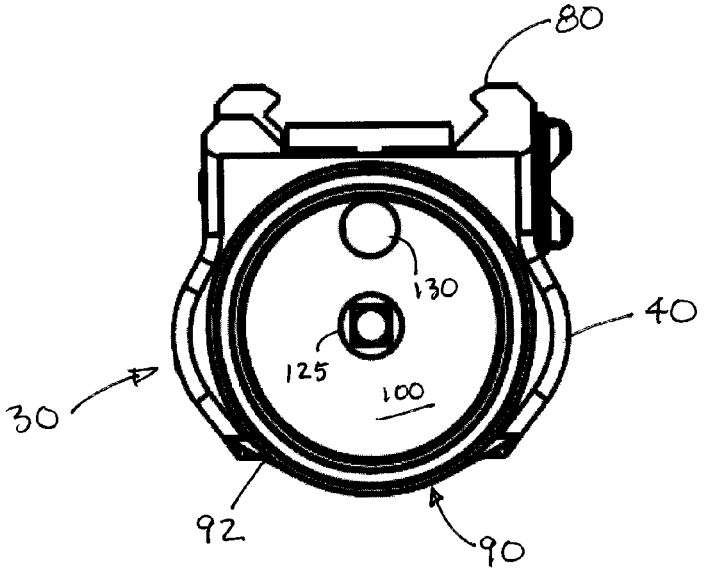
FIG. 9

PORTABLE LIGHT WITH MULTIPLE LIGHT SOURCES

FIELD OF THE INVENTION

The present invention relates to a portable light that may include an illumination source and may optionally include a second light source or laser. The present invention also relates to a switching arrangement for controlling the portable light and the circuitry for controlling the light.

BACKGROUND

Lights may be mounted to various objects, such as tools or implements so that they provide light directed toward the work area of the tool or implement. One object to which lights may be mounted is a firearm, such as a handgun or pistol, a long gun or rifle, a shotgun, or another type of gun or weapon, any one or more of which are typically referred to as a gun.

For a typical gun, the arrangement for mounting a portable light on a gun is similar to the arrangement for mounting a telescopic sight on a gun. A gun mount, also called a gun rail or a mounting rail, is typically provided in a convenient location that affords a forward-looking view for a light mounted thereon. Because a telescopic sight or other sight is typically mounted on the top or upper surface of the gun barrel, a separate mount is often provided on the side or underside (bottom) surface of the gun barrel, typically near to the muzzle end thereof.

SUMMARY OF THE INVENTION

In light of the foregoing, the present invention provides a portable light mountable on a mounting rail of a firearm. The light includes a housing configured to house a source of electrical energy and a light assembly that includes a first light element, a second light element and a reflector for focusing light of at least one of the first and second light elements. A mounting assembly connected with the housing is operable to releasably connect the housing to the mounting rail of the firearm. An actuation switch is mounted on a rearward end of the housing so that when the light is mounted on the firearm the actuation switch has an actuation surface adjacent a trigger of the firearm.

The light also includes a selector switch for selecting which of the first and second light elements is energized when the actuation switch is actuated. The selector switch may be a non-contact switch comprising an actuator and a sensor in a switching compartment sealingly separated from the actuator.

DESCRIPTION OF THE DRAWINGS

The foregoing summary and the following detailed description of the preferred embodiments of the present invention will be best understood when read in conjunction with the appended drawings, in which:

FIG. 8 is an enlarged fragmentary view of the portion of the portable light designated Detail A in FIG. 7;

FIG. 9 is an left end view of the portable light illustrated in FIG. 1.

DETAILED DESCRIPTION OF THE INVENTION

Figure 1:
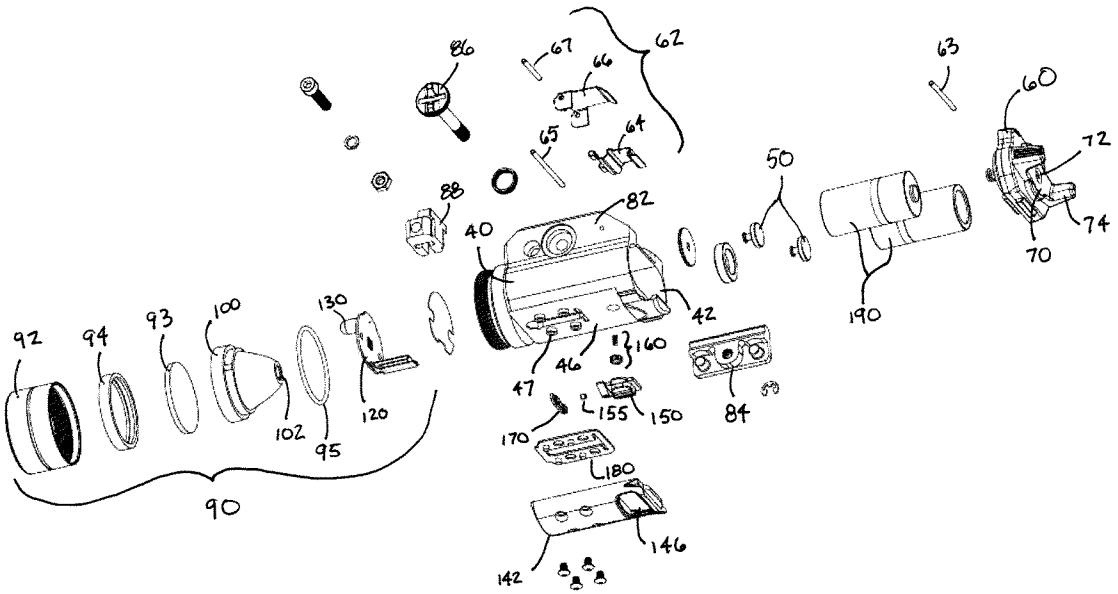
FIG. 1 is an exploded perspective view of a portable light of the present arrangement.
Figure 7:
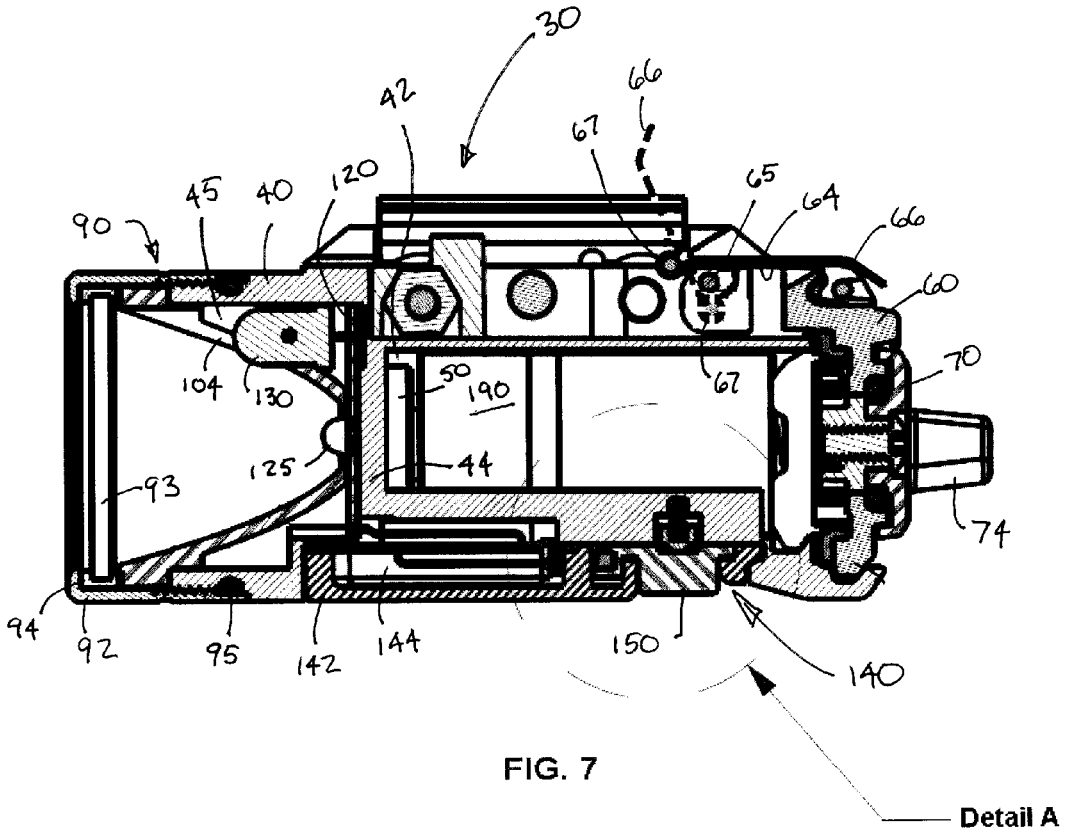
FIG. 7 is an enlarged cross-sectional view taken across line 7-7 in FIG. 3.
Figure 10:
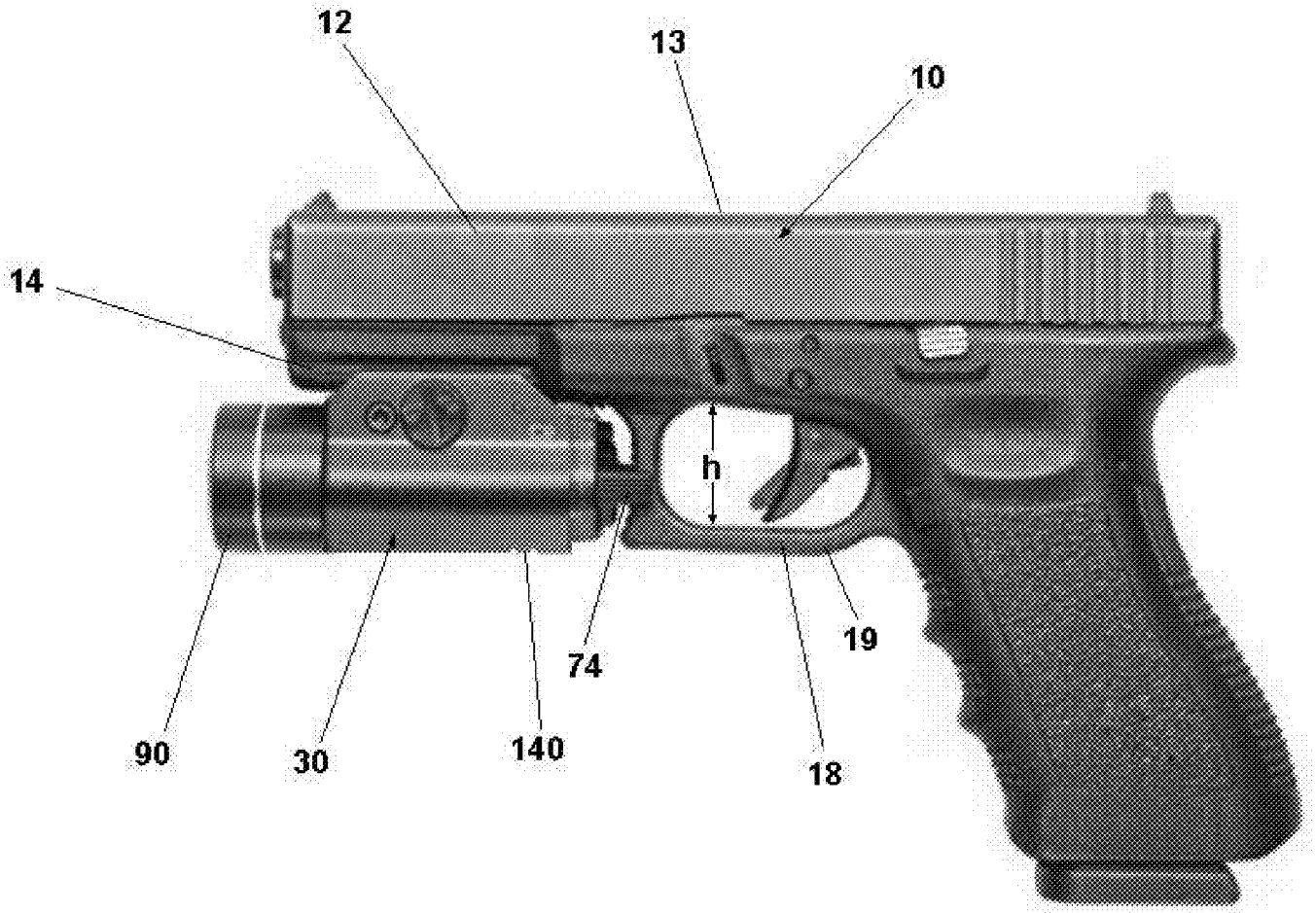
FIG. 10 is a front view of the light illustrated in FIG. 1 mounted on a firearm.

Referring now to the figures in general and to FIGS. 1 & 7 specifically, a portable light is designated generally 30. The light 30 includes a plurality of light elements 125, 130 and the user can select which light element to energize during use. Specifically, in the present instance, the light 30 includes a primary switch 70 for turning the light ON and OFF and a selector switch 140 for selecting which of the light elements 125, 130 is switched ON when the primary switch is actuated. The light 30 is configured to be attached to an implement, such as a firearm 10, as shown in FIG. 10. Moreover, the light 30 is configured so that when it is mounted onto a firearm the firearm and light can be holstered in a holster having a level III level of retention security.

Referring now to FIGS. 7 & 8, the features of the light 30 will be described in greater detail. The light 30 includes a housing 40 and a light assembly 90. The housing comprises an enlarged rearward chamber 42 forming a battery compartment for receiving the power source, which in the present instance is a pair of single use lithium batteries 190. Alternatively, the power supply may be rechargeable batteries if desired. Additionally, it should be understood the number and size of the batteries may vary depending on the application. For instance, a single battery can be used rather than a pair of batteries. Further still, a single battery can be used and a portion of a light assembly may be housed in part of the battery compartment.

The housing 40 includes a forward wall 44 generally enclosing the forward end of the battery compartment 42. Forward of the wall 44 is a chamber 45 for housing the light assembly 90. A pair of contacts 50 extend through the forward wall 44 and are in circuit with the light assembly 90 and the batteries 190 in the battery compartment 42.

The light assembly 90 may include a single light source; however in the present instance the light assembly includes a primary light element 125 and a secondary light element 130. For example, the primary light element 125 may be a high intensity light source for providing white illumination light, such as a C4 LED delivering from 100 to over 600 lumens. The secondary light 130 may be any of a variety of light elements, such as green or red light elements to limit the impact of the light on the user's night vision. Alternatively, the secondary light element may be a coherent light source such as a laser diode. However, in the present instance, the secondary light source is an LED providing an infra red invisible light source for use with night vision equipment. Accordingly, it should be understood that the term light element is used to refer to any of a variety of elements that may provide a variety of visible or invisible light in a coherent or dispersed beam.

Referring to FIG. 1, the primary light 125 and secondary light 130 are mounted on a PCB assembly 120, however, it should be understood that the two light elements 125, 130 may be mounted on separate boards. The PCB assembly 120 is positioned at the rearward end of the forward chamber 45, so that the PCB assembly abuts the wall 44. The forward wall may also provide a heat sink for transferring heat away from the light assembly 90. Specifically, the housing may be formed of a thermally conductive material such as aluminum or other metal so that heat from the light assembly is dissipated though the wall and the housing away from the light assembly electronics. In the present instance, the PCB assembly 120 is shaped to conform to the interior of the forward chamber 45. Additionally, in the present instance, the interior of the forward chamber 45 adjacent the forward wall 44 is non-circular, so that the mating shape of the PCB assembly 120 and the forward chamber operate to locate the position of the primary and secondary lights 125, 130 relative to the housing 40. Specifically, the light elements 125, 130 are positioned on the PCB at a predetermined position relative to the perimeter of the PCB. The configuration of the PCB perimeter mates with the interior of the chamber 45 to locate the PCB in a particular orientation relative to the housing. Since the primary light 125 is positioned on the PCB at a predetermined location and the secondary light 130 is positioned on the PCB at a predetermined location, the mating of the PCB and housing locate the LED at a predetermined location relative to the housing.

As mentioned above, the light assembly 90 includes a reflector 100 to focus the light from one or both of the light elements 125, 130. However, in the present instance, the reflector 100 primarily provides focusing for only the primary light element. Specifically, the primary light element protrudes through a primary aperture 102 so that the primary light element 130 is positioned along the focal axis of the reflector. The secondary light element 130 protrudes through a secondary aperture 104, which is spaced radially outwardly from the focal axis of the reflector as can be seen in FIG. 7.

As shown in FIGS. 1 and 7, the forward end of the housing 40 includes an externally threaded portion configured to mate with a cap 92 to enclose the light assembly 90. The cap 92 threadedly engages the threaded portion on the housing. Additionally, the light assembly includes a lens 93 that nests within the cap 92 overlying the reflector 100. The lens may filter the light sources 125, 130. However, in the present instance the lens 92 is a clear lens. The light assembly 90 further includes sealing elements to provide a fluid-tight seal. For instance, the lens 92 is circumscribed by an elastomeric element 94 that abuts an annular flange on the cap 92. The elastomeric element 94 provides a fluid tight seal between the lens and the cap while also dampening forces that could damage the lens, such as recoil forces when the firearm is fired or impact forces if the light is dropped. Additionally, in the present instance, a sealing o-ring 95 is disposed in a groove on the forward end of the housing to provide a fluid-tight seal between the housing 40 and the cap 92.

The rearward end of the housing 40 comprises a cover or hatch 60 that encloses the battery compartment 42. The hatch 60 includes a plurality of contacts to provide an electrical connection between the batteries. The hatch 60 further includes a tab that engages a slot in the lower wall of the housing 40, as shown in FIGS. 1 & 7. The door further includes a latch 62 to retain the hatch on the housing. The latch 62 is an over center draw latch that pulls the hatch 60 snuggly up against the housing to form a fluid-tight and dust-tight seal with the battery compartment. Specifically, the latch 62 includes a keeper member 64 having a first end that engages a hatch pin 63 mounted on the hatch. The second end of the keeper member 64 is pivotably connected with the first end of an actuation lever 66. A hinge pin 67 provides a hinge connection between the keeper member 64 and the actuation lever 66. The actuation lever 66 rotates about a post 65 fixedly connected to the housing 40.

In FIG. 7, the actuation lever 66 is shown in solid when the actuation lever is in the locked position in which the hatch 60 sealing closes the battery compartment to provide a fluid-tight seal for the housing. Rotating the actuation lever 66 counter-clockwise unlatches the hatch 60. In FIG. 7, the actuation is shown in a phantom line in a partially unlatched position. As can be seen in FIG. 7, when the actuation lever 66 is pivoted toward the unlatched position, the hinge pin 67 is driven rearwardly to the opening of the battery compartment.

Figure 4:
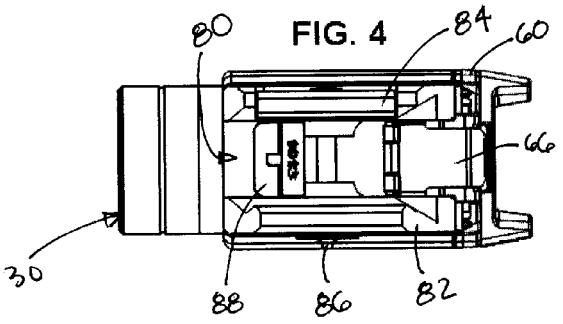
FIG. 4 is a top plan view of the portable light illustrated in FIG. 1.
Figure 2:
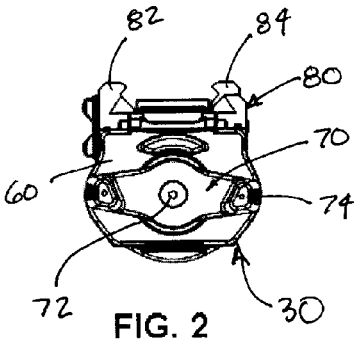
FIG. 2 is a right side view of the portable light illustrated in FIG. 1.

The hatch 60 further includes a primary switch 70 for controlling operation of the light 30. As shown in FIGS. 2-6, the switch 70 comprises a pivotable actuator. In the present instance, the switch comprises an elongated lever rotatable about an axis 72 extending through a central portion of the lever as shown in FIG. 2. Actuation surfaces 74 protrude rearwardly from each end of the switch 70 as shown in FIG. 4. Additionally, the actuation surfaces 74 of the switch terminate within the height and width of the housing so that the actuation surfaces are constrained within the perimeter of the cross-section area of the housing. In other words, the switch 70 does not extend above, below or out from the sides of the housing. In this way, the housing impedes accidental actuation of the switch.

The primary switch 70 may be actuable in a variety of manners. For example, in the present instance, pivoting the switch clockwise using either actuation surface pivots the switch into an ON position in which the switch is latched. Conversely, pivoting the switch counterclockwise pivots the switch into a momentary ON position. By momentary, it is meant that the switch is not latched; the switch will remain in the ON position only as long as the user holds the switch in the ON position. Additionally, a biasing element, such as a torsion spring, biases the switch from the momentary ON position to an OFF position. It should be noted that the terms "clockwise" and "counterclockwise" used in the foregoing description are with respect to the perspective of FIG. 2.

The switch 70 may be operable to independently control the two light elements. However, in the present instance, the switch 70 operates in connection with the selector switch 140 as described further below.

As shown in FIGS. 1 and 7, the bottom surface 46 of the housing 40 forms a generally flat surface onto which the selector switch 140 is mounted. It should be noted that FIG. 7 also illustrates a groove formed in the lower surface, which appears to show the lower surface as being a stepped surface. The selector switch 140 includes a switch cover 142 connected to the bottom surface 46 of the housing and an actuator 150 that can be manually actuated to select which of the light elements is energized. One or more elements may also be provided for aligning and connecting the switch cover to the housing. For instance, in the present instance a plurality of bosses 47 protrude downwardly from the bottom surface 46 of the housing and the switch cover 142 comprises a plurality of alignment holes to align the switch cover on the housing. Additionally, in the present instance, the bosses 47 are internally threaded and the switch cover 142 is secured onto the housing by a plurality of connectors, such as screws that threadedly engage the bosses. It may also be desirable to provide a sealed switching chamber. Accordingly, in the present instance, a seal 180 is disposed between the switch cover 142 and the bottom surface 46 of the housing. More specifically, the switch cover comprises walls that bear against the seal 180 to form a sealed switch compartment 144 on the bottom of the housing 40. In this way, the seal 180 provides a fluid-tight and dust-tight seal to impede egress of fluid into the switch compartment 144.

The selector actuator 150 rides in a slot or window 146 formed adjacent the rearward end of the switch cover 142. Specifically, the actuator 150 is laterally displaceable within the slot 146 between a plurality of positions. In the present instance, the selector switch comprises three separate selector positions. When the actuator is in a first position, the primary light element 125 is selected. When the actuator 150 is in a second position, neither of the light elements is selected; and when the actuator is in a third position, the secondary light 130 is selected. The actuator 150 is displaced between the three positions by sliding the actuator laterally within the slot 146. Additionally, it should be understood that the light can be programmed so that the various switch positions control the light elements differently than described above. For instance, in the first position, the primary light element is selected, in the second position, the second light element is selected and in the third position both light elements are selected. As another example, in the first position the first light element is selected, in the second position neither light element is selected and in the third position both light elements are selected. Other variations are possible depending on the types of light elements used and the use of the light 30.

Referring to FIGS. 1 and 8, the actuator comprises a rear lip 152 that rides in a recess adjacent the rearward edge of the slot 146 and a front flange 154 that rides in a groove 148 adjacent the forward edge of the slot 146. As shown in FIG. 8, the flange of the actuator 150 rides along the rear wall 149 of the switch compartment 144 so that the actuator is sealed from the switch compartment 144. In other words, the actuator does not extend into the switch compartment.

The selector actuator 150 may include a retainer 160 for releasably retaining the actuator in each of the three positions. For instance, a plurality of separate recesses may be formed in the bottom surface of the actuator, wherein each recess corresponds to one of the three switch positions. A spring loaded retainer 160 projects upwardly from a recess in the housing 40. The retainer bears against the underside of the actuator 150 so that when the actuator is displaced into one of the switching positions, the retainer extends into the corresponding recess in the actuator to hold the actuator in position.

In the present instance, the selector switch 140 is a non-contact switch. A first element of the switch is connected to the actuator 150 outside the sealed switch compartment 144 while a second element of the switch is disposed within the sealed switch compartment. Since the switch is a non-contact switch, the first and second elements operate to control the switching without the first and second elements being physically connected. For example, in the present instance the switch includes a magnet 155 connected to the actuator 150. A sensor circuit 170 operable to detect the magnetic field of the magnet is positioned within the switch compartment 144. The sensor circuit is operable to detect the position of the actuator 150. More specifically, the output voltage from the sensor circuit changes in the presence of the magnetic field from the magnet 155.

Figure 11:
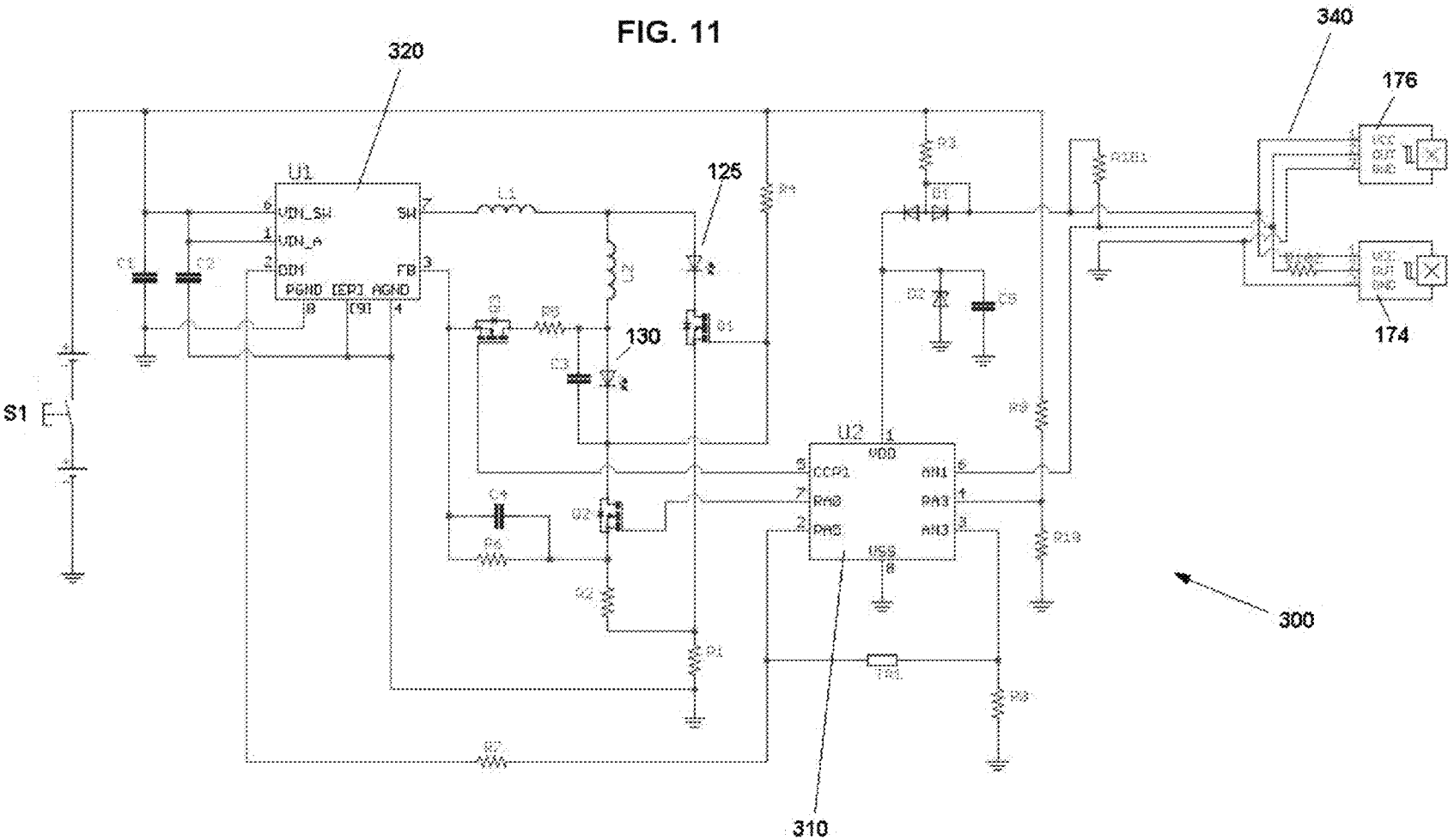
FIG. 11 is a schematic of a circuit for the portable light illustrated in FIG. 1.

Referring to FIGS. 1, 8 and 11, the sensor circuit 170 comprises first and second sensors 174, 176 mounted on a PCB 172. An aperture in the lower surface 46 of the housing allows three leads from the sensor PCB to connect with the PCB 120 of the light assembly 90. The sensor circuit 170 is positioned within the sealed switch compartment 144 separated from the actuator 150 by the rear wall 149 of the switch cover 142. The sensors are spaced apart from one another on the PCB to provide a gap between the sensors. In this way, when the magnet 155 in the actuator is adjacent the first sensor 174, the first sensor detects the magnetic field changes the voltage output from the sensor circuit. At the same time, the magnetic field of the magnet is insufficient to be detected by the second sensor 176. Additionally, in the present instance, when the magnet is positioned midway between the sensors 174, 176, the magnetic field of the magnet is insufficient to be detected by either of the sensors. Additionally, it may be desirable to provide an element to isolate the sensors 174, 176 from the magnetic field of the magnet to ensure that neither sensor detects the magnetic field when the switch is positioned between the sensors. For instance, a ferrous wall or plate may be disposed between the sensors, such as a plate 145 connected to wall 149 between the two sensors 174, 176. In this way, as the magnet moves toward the midway position, the ferrous plate 145 attracts the magnetic field of the magnet, essentially short circuiting the magnetic field so that the magnetic field does not extend toward either sensor 174, 176.

Figure 3:
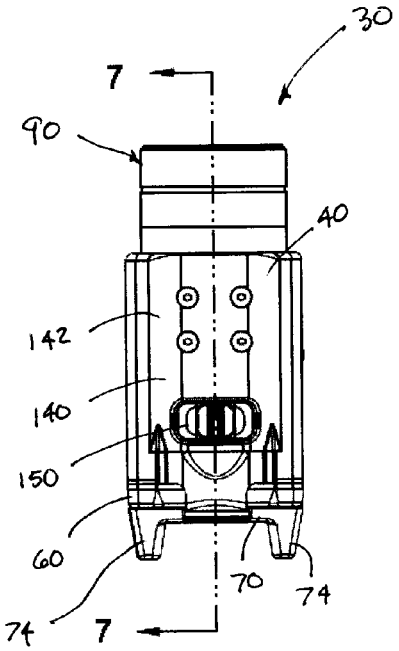
FIG. 3 is a bottom plan view of the portable light illustrated in FIG. 1.
Figure 5:
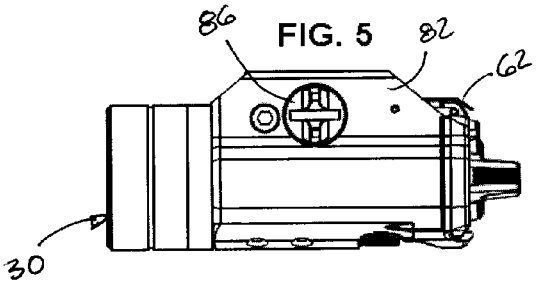
FIG. 5 is a front view of the portable light illustrated in FIG. 1.
Figure 6:
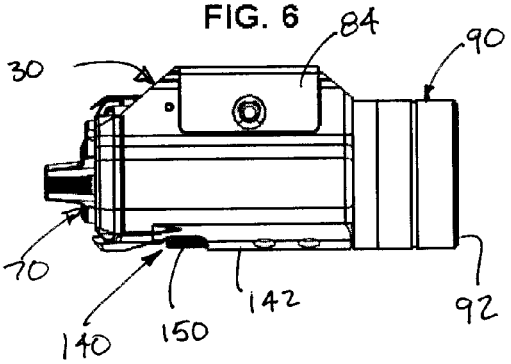
FIG. 6 is a rear view of the portable light illustrated in FIG. 1.

Configured as described above, in the present instance, the selector switch 140 includes three positions: a left position, a center position and a right position (from the perspective of FIG. 3). In the right position, the magnet 155 in the actuator 150 is aligned with the first sensor 174 to turn the output on so that the sensor circuit 170 provides a first output voltage. When the actuator 150 is displaced into the center position (as shown in FIG. 3), the magnet 155 is positioned midway between the sensors 174, 176 so that neither sensor detects the magnet and the sensor circuit provides a second output voltage. When the actuator 150 is displaced into the left position, the magnet 155 is aligned with the second sensor 176 to turn the output on so that the sensor circuit provides a third output voltage. The selector switch 140 and the sensor circuitry can be altered to provide a variety of switching positions, including more than three positions by using additional sensors. In the present instance, when the actuator 150 is in the left position, the primary light element 125 is selected so that when the primary switch 70 is actuated the primary light is illuminated. When the actuator is in the center position, neither light element is illuminated when the primary switch 70 is actuated. And when the actuator 150 is in the right position the secondary light element 130 is illuminated when the primary switch 70 is actuated. However, as described previously, the light 30 can be programmed so that the position of the selector switch changes which of the light elements is illuminated when the primary switch is actuated.

Any of a variety of mounting elements may be used for releasably connecting the light 30 to an implement. One exemplary mounting assembly 80 is illustrated in the figures for releasably mounting the light 30. In the present instance, the mounting assembly 80 is particularly suited for connecting the light 30 to a firearm 10. Referring to FIG. 10, a firearm 10, such as a handgun, may include a mounting rail 14 formed on the underside of the barrel of the gun. The configuration of the mounting rail 14 may vary; however, the mounting rail typically incorporates a pair of parallel slots or other structure to facilitate rigidly mounting an item to the firearm.

The mounting assembly 80 comprises a clamp that includes at least one moveable jaw. For instance, the mounting assembly includes a fixed jaw 82 rigidly connected with the top of the housing 40. A moveable jaw 84 is connected to the top of the housing 40 spaced apart from fixed jaw 82. An adjustment bolt 86 threadedly engages the moveable jaw 84 to drive the moveable jaw toward or away from the fixed jaw 82. In this way, operating the adjustment bolt is operable to tighten or loosen the mounting assembly. As can be seen in FIGS. 2 and 8, the fixed and moveable jaws 82, 84 may be undercut to form a sliding dovetail configuration to clamp onto the mounting rail 14.

Referring to FIG. 1, the mounting assembly may also incorporate a mounting key 88 to engage structure on the mounting rail of a firearm to impede movement of the light along the length of the barrel. For instance, the key 88 may fit into a notch extending between the parallel slots of the mounting rail 14. The key 88 may be releasably connected to the mounting assembly so that the key can be replaced with a different configuration depending on the configuration of the rail on the handgun on which the light is to be mounted.

Referring now to FIGS. 7 and 9-10, several features of the light can be seen. For instance, as shown in FIG. 9, the light assembly 90 has a circumference defined by the outer diameter of the cap 92. As can be seen in FIGS. 7 & 9, the selector switch 140 and the switch compartment 144 are low-profile elements that do not protrude beyond the circumference of the light assembly. Specifically, the bottom of the selector switch cover 142 may be above the lowest point of the light assembly 90 (from the perspective of FIG. 9), and in the present instance, the bottom of the selector switch is aligned with or not substantially below the lowest point of the light assembly. Further still, the actuator 150 does not project beyond the bottom of the selector switch cover. In other words, the outer surfaces of the selector switch 140 and the switch compartment 144 both either terminate without substantially protruding beyond, or terminate within, the cross-sectional boundary defined by the outer surface of the light assembly 90. Additionally, both the selector switch 140 and the primary switch 70 are positioned toward the rearward end of the light 30. In this way, when the light 30 is mounted onto a firearm 10 both switches are rearward of the muzzle of the firearm.

Additionally, referring to FIG. 10, the firearm includes a trigger guard 18 that circumscribes the trigger to impede accidental operation of the firearm trigger. As shown in FIG. 10, barrel 12 has an upper surface 13, which may form a generally linear upper edge. The trigger guard may have a low point defined as the portion of the trigger guard 18 that is spaced farthest from a point on the upper surface 13. For instance, portion 19 is the low point on the trigger guard 18 of firearm 10.

In the present instance, the primary switch 70 is configured so that the actuation surfaces 74 protrude rearwardly from opposing sides of the trigger guard. In this way, if the user is left-handed, the user can readily actuate the actuation surface 74 protruding from the left side of the trigger guard 18, while if the user is right-handed, the user can actuate the actuation surface protruding from the left side of the trigger guard. Further still, the light 30 is configured so that when the light is mounted on a firearm, the light does not substantially hang below the trigger guard 18. Specifically, the opening of the trigger guard 18 has a height "h" as shown in FIG. 10. The light is configured so that the lowest point of the light hangs below the trigger guard less than ¼ the height "h" and preferably less than approximately ⅛ the height "h". When determining the lowest point that the light hangs below the trigger guard, the determination may be made relative to any point on the trigger guard or it may be made relative to the lowest point 19 of the trigger guard.

FIG. 11 is an electrical schematic diagram of example electronic circuitry 300 suitable for use with the example portable light 30. DC power for the circuit is provided by one or more batteries in FIG. 11. Although any of a variety of batteries may be used to power the circuit, in the present instance a pair of batteries provide approximately 6.0 volts to power the circuit 300. In particular, in the present instance a pair of CR123 batteries powers the circuit.

To accommodate a range of voltages produced by different types of batteries, light 30 preferably includes electronic circuitry that can receive and operate over a range of input (e.g., battery) voltages, e.g., a range of about 0.5 to about 8.4 volts, and that can transform a voltage in that range to a preferred output voltage suitable for operating light sources 125, 130 at a desired operating condition, typically at a desired current level. In the present instance, the circuitry is operable over a range of input voltages of between approximately 2.5-6.5 volts.

The circuit includes first and second driven loads 125, 130 driven by switching transistors Q1 and Q2. The drive control to the gates of Q1 and Q2 is provided by the microcontroller U2 designated 310. Controller 310 is preferably an integrated circuit U2 that includes processing for controlling and operating light 30 and a memory for storing instructions for controlling and operating light, e.g., software instructions. Integrated circuit U2 preferably is a digital processor, such as a microprocessor, that receives signals at several of its terminals, that processes those received signals in accordance with software instructions stored in its memory, and that provides controlling signals at others of its terminals for controlling electronic circuits connected thereto that control and operate light sources 125, 130, selector detectors 174, 176, and current controller U1.

The circuit 300 includes a single regulator circuit 320 that controls the current to primary light element 125 and secondary light element 130. The regulator circuit 320 includes integrated circuit U1 along with two inductors L1 and L2, wherein the inductance of L2 is significantly higher than the inductance of L1.

Sensor circuit 340 includes two sensors 174, 176 that provide a voltage to U2 in response to the position of the selector switch. For instance, sensors 174, 176 may be Hall Effect sensors operable to provide a voltage in response to being in proximity to the magnetic field of magnet 155 (shown in FIG. 8).

The operating program for U2 selects the appropriate gate of Q1 or Q2 in response to the position of the selector switch. In the present instance, when neither sensor 174, 176 detects the magnetic field from the magnet 155 in the actuator 150, a first voltage is provided to the pin AN1. In response, the controller U2 controls Q1 and Q2 so that both are off. When the selector switch is disposed in a position in which the primary light source 125 is selected, a second voltage is provided to pin AN1 of the controller U2 from the first sensor 174 of selector circuit 340. In the present instance, the first voltage is less than the first voltage due to resistor R102 in series with sensor 174. In response, controller U2 controls transistors Q1, Q2 so that Q1 is on and Q2 is off. When the selector switch is disposed in a position in which the secondary light source is selected, a third voltage is provided to pin AN1 of controller U2 from the second sensor 176 of the selector circuit 340. In the present instance, when the second sensor 176 detects the magnetic field of magnet 155, the output of selector circuit 170 goes to ground so that the third voltage provided to pin AN1 is essentially zero.

In a typical embodiment of circuit 300, power controller 320 may employ, e.g., a type ST1 CC40 synchronous boost converter integrated circuit available from ST Microelectronics, Inc. located in Santa Clara, Calif. However, it should be understood that any other suitable DC converter integrated circuit may be utilized, such as a type LED2000 step-down current source integrated circuit available from ST Microelectronics, Inc. Controller 310 may employ, e.g., a type PIC12F752 embedded micro-controller integrated circuit available from Microchip Technology, Inc., located in Chandler, Ariz., or any other suitable processor circuit of which many are available commercially from several different suppliers.

Typically, controller integrated circuits (IC) have various "ports" at which data may be received by controller IC 310 and/or provided by controller IC. Each port commonly connects to plural terminals of controller IC and the functioning thereof may be configured or programmed by instructions stored in the memory of IC so as to have different characteristics, e.g., to serve as an analog input, as an analog output, as a digital input or as a digital output. Typically each port corresponds to plural terminals (pins) of the physical integrated circuit, wherein when the port is configured as a digital port, each pin carries one bit of a multi-bit digital signal received and/or outputted as a parallel multi-bit digital "word" when the data output is digital, and as plural analog terminals wherein the port is configured as an analog port. One common format provides ports as, e.g., an eight-bit port (a port using eight terminals of the physical IC). In some instances, the terminals of controller IC may be configured individually or in groups partly as digital terminals and partly as analog terminals.

A user or operator of light 30 controls the operation of light by actuating a switch S1, e.g., of an ON/OFF signaling circuit. Instructions from the operator or user of light 30 are provided to controller 310 U2 via ON/OFF signaling circuit that includes a user actuated switch S1, e.g., the primary switch 70, to signal input RA3 of controller U2. Blocking diode D1 is connected to voltage VDD through resistor R3 so that voltage VDD is applied to controller U2.

Switch S1, 70 may be actuated one or more times and/or for various times and durations for signaling a desired operating condition. For example, in a first position, the switch S1 may act as a momentary switch so that light 30 is switched ON as long as the user holds switch S1 in the first position. A sequence of momentary actuations of switch S1 into the first position may be employed to signal controller U1 to operate in a blinking mode or in a flashing mode or in a strobe mode, or in another desired mode.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A portable light mountable on a mounting rail on a firearm having a trigger guard around a trigger, wherein the trigger has an axial length, comprising:

a housing configured to house a source of electrical energy;

a light assembly, comprising:

a first light element;

a second light element;

a reflector for focusing light of at least one of the first and second light elements;

wherein the light assembly has an outer surface defining a perimeter of the light assembly;

a mounting assembly connected with the housing, wherein the mounting assembly is operable to releasably connect the housing to the mounting rail of the firearm;

an actuation switch mounted on a first end of the housing so that when the light is mounted on the firearm the actuation switch has an actuation surface adjacent a trigger guard of the firearm so that the actuation surface is less than the axial length of the trigger away from the trigger guard;

a selector switch for selecting which of the first and second light elements is energized when the actuation switch is actuated, wherein the selector switch is a non-contact switch comprising an actuator and a sensor in a switching compartment sealingly separated from the actuator;

wherein the selector switch comprises a magnetic element connected with the actuator and a plurality of sensors for providing an output voltage in response to being in proximity with the magnetic element; and wherein when the actuator is in a first position, a first of the sensors provides an output voltage while a second of the sensors does not provide an output voltage; and wherein when the actuator is in a second position, a second of the sensors provides an output voltage while the first sensor does not provide an output voltage.

2. The light of claim 1 wherein the light comprises a processor receiving signals from the sensors and controlling which of the first and second light elements is energized in response to which sensor provides an output voltage.

3. The light of claim 1 wherein the selector switch comprises a sealed switch compartment to impede ingress of fluid into the switch compartment from outside the light, wherein the plurality of sensors is within the switch compartment and the actuator is outside the switch compartment.

4. The light of claim 1 wherein the selector switch is positioned on a lower surface of the housing.

5. The light of claim 4 wherein the selector switch is configured so that the selector switch does not substantially protrude radially outwardly beyond the perimeter of the light assembly.

6. The light of claim 5 wherein the selector switch is configured so that the outer surface of the selector switch terminates within the perimeter of the light assembly.

7. The light of claim 1 wherein the selector switch is positioned rearwardly of a midpoint of the length of the light.

8. The light of claim 1 wherein light from the first light element projects forwardly along a first axis and the actuation switch is actuable by displacing the actuation surface in a first actuation direction that is transverse the first axis and the selector switch is actuable by displacing an actuator in a second actuation direction transverse either the first axis or the first actuation direction.

9. The light of claim 8 wherein the second actuation direction is transverse the first axis and the first actuation direction.

10. The light of claim 1 wherein the mounting assembly and actuation switch are configured so that when the light is mounted on the firearm the actuation switch extends rearwardly to overlap a portion of the trigger guard.

11. The light of claim 1 wherein the actuation switch is configured so that the actuation switch straddles the trigger guard when the light is mounted on the firearm.

12. The light of claim 1 wherein the second light element is a laser.

13. A portable light mountable on a mounting rail of a firearm, wherein the firearm has a trigger having an axial length and a trigger guard around the trigger, wherein the light comprises:

a housing configured to house a source of electrical energy;

a light assembly connected with a forward end of the housing, comprising:

a first light element;

a second light element;

a reflector for focusing light of at least one of the first and second light elements;

wherein the light assembly has an outer surface defining a perimeter of the light assembly;

a mounting assembly connected with the housing, wherein the mounting assembly is operable to releasably connect the housing to the mounting rail of the firearm;

an actuation switch mounted on a rearward end of the light so that when the light is mounted on the firearm the actuation switch has an actuation surface adjacent a trigger guard of the firearm such that the actuation surface is spaced from the trigger guard less than the axial length of the trigger;

a selector switch for selecting which of the first and second light elements is energized when the actuation switch is actuated wherein the selector switch comprises a sealed switch compartment to impede ingress of fluid into the switch compartment from outside the light, wherein the selector switch comprises an actuation surface that does not protrude radially outwardly beyond the perimeter of the light assembly.

14. The light of claim 13 wherein the selector switch is configured so that the outer surface of the selector switch terminates within the perimeter of the light assembly.

15. The light of claim 13 wherein the selector switch is positioned rearwardly of a midpoint of the length of the light.

16. The light of claim 13 wherein the selector switch is positioned on a lower surface of the housing opposite from the mounting assembly.

17. The light of claim 13 wherein light from the first light element projects forwardly along a first axis and the actuation switch is actuable by displacing the actuation surface in a first actuation direction that is transverse the first axis and the selector switch is actuable by displacing an actuator in a second actuation direction transverse either the first axis or the first actuation direction.

18. The light of claim 17 wherein the second actuation direction is transverse the first axis and the first actuation direction.

19. The light of claim 13 wherein the mounting assembly and actuation switch are configured so that when the light is mounted on the firearm the actuation switch extends rearwardly to overlap a portion of the trigger guard.

20. The light of claim 13 wherein the actuation switch is configured so that the actuation switch straddles the trigger guard when the light is mounted on the firearm.

21. The light of claim 13 wherein the second light element is a laser.

22. The light of claim 13 wherein the actuation switch is operable to switch the light assembly between an ON condition and an OFF condition.

23. A portable light mountable on a mounting rail of a firearm, wherein the firearm has a trigger guard surrounding a trigger, and wherein the light comprises:

a housing configured to house a source of electrical energy, wherein the housing has a forward end and a rearward end;

a light assembly at the forward end of the housing, comprising:

a first light element;

a second light element;

a mounting assembly connected with the housing, wherein the mounting assembly is operable to releasably connect the housing to the mounting rail of the firearm;

an actuation switch on the rearward end of the housing;

a selector switch for selecting which of the first and second light elements is energized when the actuation switch is actuated wherein the selector switch comprises a sealed switch compartment to impede ingress of fluid into the switch compartment from outside the light, wherein the selector switch is positioned rearwardly of the midpoint of the length of the light and is configured so that the selector switch does not substantially protrude below the trigger guard when the light is mounted on the firearm;

wherein the actuation switch is an elongated switch having a first actuation surface at a first end of the switch and a second actuation surface at a second end of the switch and wherein the actuation switch is rotatable about an axis located along the length of the actuation switch between the first actuation surface and the second actuation surface and wherein the axis is along a line that extends through the forward end of the housing and the rearward end of the housing;

wherein the actuation switch is configured so that the first and second actuation surfaces straddle the trigger guard when the light is mounted on the firearm and the first and second actuations surfaces project rearwardly away from the housing so that the first and second actuation surfaces project rearwardly from a front edge of the trigger guard when the light is mounted on the firearm.

24. The light of claim 23 wherein the selector switch is on a lower surface of the housing, opposite the mounting assembly and wherein the trigger guard has an opening having a height and the selector switch protrudes below the trigger guard at most ¼ the height of the opening of the trigger guard.

25. The light of claim 23 wherein the selector switch is positioned adjacent the actuation switch when the light is mounted on the firearm.

26. The light of claim 23 wherein the selector switch is positioned on a lower surface of the housing opposite the mounting assembly.

27. The light of claim 23 wherein light from the first light element projects forwardly along a first axis and the actuation switch is actuable by displacing the actuation surface in a first actuation direction that is transverse the first axis and the selector switch is actuable by displacing an actuator in a second actuation direction transverse either the first axis or the first actuation direction.

28. The light of claim 27 wherein the second actuation direction is transverse the first axis and the first actuation direction.

29. The light of claim 23 wherein the mounting assembly and actuation switch are configured so that when the light is mounted on the firearm the actuation switch extends rearwardly to overlap a portion of the trigger guard.

30. The light of claim 23 wherein the second light element is a laser.

31. The light of claim 23 wherein the actuation switch is operable to switch the light assembly between an ON condition and an OFF condition.

32. The light of claim 31 wherein the light assembly comprises a reflector having a width and the selector switch is configured so that the selector switch does not substantially protrude radially outwardly beyond the width of the reflector.

33. The light of claim 23 wherein the light assembly has an outer perimeter and the selector switch is configured so that the selector switch does not substantially protrude radially outwardly beyond the perimeter of the light assembly.

* * * * *